US010262568B2

(12) United States Patent
Wang

(10) Patent No.: US 10,262,568 B2
(45) Date of Patent: Apr. 16, 2019

(54) COLOR TEMPERATURE ADJUSTING SYSTEM OF TRANSPARENT DISPLAY AND COLOR TEMPERATURE ADJUSTING METHOD OF TRANSPARENT DISPLAY

(71) Applicant: Shenzhen China Star Optoelectronics Semiconductor Display Technology Co., Ltd., Shenzhen (CN)

(72) Inventor: Limin Wang, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/570,377

(22) PCT Filed: Jul. 13, 2017

(86) PCT No.: PCT/CN2017/092872

§ 371 (c)(1),
(2) Date: Oct. 30, 2017

(87) PCT Pub. No.: WO2018/218749

PCT Pub. Date: Dec. 6, 2018

(65) Prior Publication Data

US 2018/0342188 A1 Nov. 29, 2018

(30) Foreign Application Priority Data

May 27, 2017 (CN) ..... 2017 1 0393649

(51) Int. Cl.
*G09G 3/20* (2006.01)

(52) U.S. Cl.
CPC ... *G09G 3/2003* (2013.01); *G09G 2320/0666* (2013.01)

(58) Field of Classification Search
None
See application file for complete search history.

(56) References Cited

U.S. PATENT DOCUMENTS 9,489,918 B2 * 11/2016 Zhang ..... G09G 5/02
2015/0206468 A1 * 7/2015 Wu ..... G06F 3/14 345/207
2016/0351165 A1 * 12/2016 Chang ..... G06F 3/04842

FOREIGN PATENT DOCUMENTS

CN 102707487 A 10/2012
CN 104981077 A 10/2015

* cited by examiner

*Primary Examiner* — Kenneth B Lee, Jr.
(74) *Attorney, Agent, or Firm* — Leong C. Lei

(57) ABSTRACT

Provided are a color temperature adjusting system of a transparent display and a color temperature adjusting method of a transparent display. The display mode or the fusion mode is selected via the mode selecting module (1) of the system. The display color temperature adjusting module (2) is configured to give different color temperature adjusting results according to a mode selected by the user and the color temperature of the environment, in which the transparent display (4) is located. As the user selects the display mode, the display color temperature adjusting module (2) uses a preset fixed color temperature as the color temperature adjusting results; as the user selects the fusion mode, the display color temperature adjusting module (2) uses a color temperature consistent with the color temperature of the environment obtained by the environmental color temperature detecting module (3) as the color temperature adjusting result.

9 Claims, 5 Drawing Sheets

COLOR TEMPERATURE ADJUSTING SYSTEM OF TRANSPARENT DISPLAY AND COLOR TEMPERATURE ADJUSTING METHOD OF TRANSPARENT DISPLAY

FIELD OF THE INVENTION

The present invention relates to a transparent display field, and more particularly to a color temperature adjusting system of a transparent display and a color temperature adjusting method of a transparent display.

BACKGROUND OF THE INVENTION

In the display field, Liquid Crystal Display (LCD), Organic Light Emitting Diode (OLED) and other panel display devices have been gradually replaced the Cathode Ray Tube (CRT) displays. The LCD (Liquid Crystal Display) possesses many advantages of being ultra thin, power saved and radiation free. It has been widely utilized. The Organic Light Emitting Display (OLED) display possesses many outstanding properties of self-illumination, low driving voltage, high luminescence efficiency, short response time, high clarity and contrast, near 180° view angle, wide range of working temperature, applicability of flexible display and large scale full color display and therefore is considered as a dream display. The OLED can be categorized as Passive matrix OLED (PMOLED) and (Active matrix OLED) AMOLED according to their driving types.

However, the LCD and OLED of prior art cannot be applied to all occasions, such as displaying and meanwhile, allowing to see the scene behind the monitor through the monitor. The transparent display for meeting such needs as a new display technology has drawn more and more attentions. The transparent display allows the audience can watch the background behind the display through the display at the same time as showing images. With the fusion of the display images and the background, the viewing experience better than the ordinary display can be provided as an excellent carrier of exhibition and the augmented reality (AR) enhancement.

The color temperature has bigger influence to the display quality of the display. The display color temperature of the ordinary LCD or OLED is adjusted according to the user's preferences. It only considers the display result and cannot be applied for the special applications of the transparent display. The transparent display of prior art has a fixed color temperature. As the color temperature of the environment in which the transparent display is located is changed, the color temperature of the transparent display does not change. Then, as performing the image display and the background display at the same time, a larger color temperature difference may exist for the display image and the background and the viewing experience of the user is worse.

The invention patent application No. CN103504881A filed an interactive display window. The interactive display window utilizes a transparent display, comprising a sensor module and a touch module, which can implement the adjustments of color temperature, brightness and spectral characteristics to the light source according to the results of environment sensing and user touch instructions so as to improve the viewing effect. However, the application can only be applied for the LCD transparent display having the backlight source. The application scene is limited and the corresponding adjustment for the transparent display color temperature and environmental color temperature cannot be realized.

SUMMARY OF THE INVENTION

An objective of the present invention is to provide a color temperature adjusting system of a transparent display, which can perform various color temperature adjustment based on the working mode of the transparent display to harmonize the transparent display color temperature with the environmental color temperature and to improve the transparent display viewing experience.

Another objective of the present invention is to provide a color temperature adjusting method of a transparent display, which can perform various color temperature adjustment based on the working mode of the transparent display to harmonize the transparent display color temperature with the environmental color temperature and to improve the transparent display viewing experience.

For realizing the aforesaid objectives, the present invention first provides a color temperature adjusting system of a transparent display, comprising a mode selecting module, a display color temperature adjusting module communicating with the mode selecting module, an environmental color temperature detecting module communicating with the display color temperature adjusting module and the transparent display communicating with the display color temperature adjusting module;

wherein the mode selecting module has a display mode and a fusion mode for an user to select;

the environmental color temperature detecting module detects and obtains a color temperature of an environment in which the transparent display is located;

the display color temperature adjusting module is configured to give different color temperature adjusting results according to a mode selected by the user and the color temperature of the environment, in which the transparent display is located, obtained by the environmental color temperature detecting module: as the user selects the display mode, the display color temperature adjusting module uses a preset fixed color temperature as the color temperature adjusting result; as the user selects the fusion mode, the display color temperature adjusting module uses a color temperature consistent with the color temperature of the environment, in which the transparent display is located, obtained by the environmental color temperature detecting module as the color temperature adjusting result;

the transparent display receives the color temperature adjusting result of the display color temperature adjusting module to perform a transparent display at the corresponding color temperature.

The mode selecting module allows selecting the mode with a bottom or a touch control.

The display color temperature adjusting module comprises an information receiving and processing unit and a gamma voltage lookup table; the gamma voltage lookup table stores a plurality of gamma voltage values and one gamma voltage value corresponds to one color temperature;

the information receiving and processing unit receives information of the mode selected by the user and information of the color temperature of the environment, in which the transparent display is located, obtained by the environmental color temperature detecting module and retrieves the gamma voltage lookup table according to received information and then, selects a gamma voltage value corresponding to the received information and transmits the gamma voltage value which is selected to the transparent display to control the transparent display to perform transparent displaying at the color temperature corresponding to the gamma voltage value which is selected.

As the user selects the display mode, the information receiving and processing unit selects a gamma voltage value corresponding to the preset fixed color temperature in the gamma voltage lookup table to control the transparent display to perform a transparent displaying at the preset fixed color temperature; as the user selects the fusion mode, the information receiving and processing unit selects a gamma voltage value corresponding to the color temperature consistent with the color temperature of the environment, in which the transparent display is located, obtained by the environmental color temperature detecting module to control the transparent display to perform a transparent displaying at the color temperature consistent with the color temperature of the environment, in which the transparent display is located, obtained by the environmental color temperature detecting module.

The transparent display is a liquid crystal transparent display or an organic light emitting diode transparent display.

The present invention further provides a color temperature adjusting method of a transparent display, comprising steps of:

Step S1, providing a color temperature adjusting system of the transparent display;

wherein the color temperature adjusting system comprises a mode selecting module, a display color temperature adjusting module communicating with the mode selecting module, an environmental color temperature detecting module communicating with the display color temperature adjusting module and the transparent display communicating with the display color temperature adjusting module; wherein the mode selecting module has a display mode and a fusion mode for an user to select;

the environmental color temperature detecting module detects and obtains a color temperature of an environment in which the transparent display is located;

Step S2, entering Step S3 as the user selects the display mode via the mode selecting module; entering Step S4 as the user selects the fusion mode via the mode selecting module;

Step S3, giving a color temperature adjusting result corresponding to a preset fixed color temperature by the display color temperature adjusting module and transmitting the same to the transparent display and then, directly entering Step S5;

Step S4, giving a color temperature adjusting result consistent with the color temperature of the environment, in which the transparent display is located, obtained by the environmental color temperature detecting module and transmitting the same to the transparent display by the display color temperature adjusting module;

Step S5, receiving the color temperature adjusting result of the display color temperature adjusting module by the transparent display to perform a transparent displaying at the corresponding color temperature.

The mode selecting module allows selecting the mode with a bottom or a touch control.

The display color temperature adjusting module comprises an information receiving and processing unit and a gamma voltage lookup table; the gamma voltage lookup table stores a plurality of gamma voltage values and one gamma voltage value corresponds to one color temperature;

the information receiving and processing unit receives information of the mode selected by the user and information of the color temperature of the environment, in which the transparent display is located, obtained by the environmental color temperature detecting module and retrieves the gamma voltage lookup table according to received information and then, selects a gamma voltage value corresponding to the received information and transmits the gamma voltage value which is selected to the transparent display to control the transparent display to perform transparent displaying at the color temperature corresponding to the gamma voltage value which is selected.

As the user selects the display mode, the information receiving and processing unit selects a gamma voltage value corresponding to the preset fixed color temperature in the gamma voltage lookup table to control the transparent display to perform a transparent displaying at the preset fixed color temperature; as the user selects the fusion mode, the information receiving and processing unit selects a gamma voltage value corresponding to the color temperature consistent with the color temperature of the environment, in which the transparent display is located, obtained by the environmental color temperature detecting module to control the transparent display to perform a transparent displaying at the color temperature consistent with the color temperature of the environment, in which the transparent display is located, obtained by the environmental color temperature detecting module.

The transparent display is a liquid crystal transparent display or an organic light emitting diode transparent display.

The present invention further provides a color temperature adjusting system of a transparent display, comprising a mode selecting module, a display color temperature adjusting module communicating with the mode selecting module, an environmental color temperature detecting module communicating with the display color temperature adjusting module and the transparent display communicating with the display color temperature adjusting module;

wherein the mode selecting module has a display mode and a fusion mode for an user to select;

the environmental color temperature detecting module detects and obtains a color temperature of an environment in which the transparent display is located;

the display color temperature adjusting module is configured to give different color temperature adjusting results according to a mode selected by the user and the color temperature of the environment, in which the transparent display is located, obtained by the environmental color temperature detecting module: as the user selects the display mode, the display color temperature adjusting module uses a preset fixed color temperature as the color temperature adjusting result; as the user selects the fusion mode, the display color temperature adjusting module uses a color temperature consistent with the color temperature of the environment, in which the transparent display is located, obtained by the environmental color temperature detecting module as the color temperature adjusting result;

the transparent display receives the color temperature adjusting result of the display color temperature adjusting module to perform a transparent display at the corresponding color temperature;

wherein the mode selecting module allows selecting the mode with a bottom or a touch control;

wherein the display color temperature adjusting module comprises an information receiving and processing unit and a gamma voltage lookup table; the gamma voltage lookup table stores a plurality of gamma voltage values and one gamma voltage value corresponds to one color temperature;

the information receiving and processing unit receives information of the mode selected by the user and information of the color temperature of the environment, in which the transparent display is located, obtained by the environmental color temperature detecting module and retrieves the gamma voltage lookup table according to received information and then, selects a gamma voltage value corresponding to the received information and transmits the gamma voltage value which is selected to the transparent display to control the transparent display to perform transparent displaying at the color temperature corresponding to the gamma voltage value which is selected;

wherein as the user selects the display mode, the information receiving and processing unit selects a gamma voltage value corresponding to the preset fixed color temperature in the gamma voltage lookup table to control the transparent display to perform a transparent displaying at the preset fixed color temperature; as the user selects the fusion mode, the information receiving and processing unit selects a gamma voltage value corresponding to the color temperature consistent with the color temperature of the environment, in which the transparent display is located, obtained by the environmental color temperature detecting module in the gamma voltage lookup table to control the transparent display to perform a transparent displaying at the color temperature consistent with the color temperature of the environment, in which the transparent display is located, obtained by the environmental color temperature detecting module;

wherein the transparent display is a liquid crystal transparent display or an organic light emitting diode transparent display.

The benefits of the present invention are: the present invention provides a color temperature adjusting system of a transparent display. The display mode or the fusion mode is selected via the mode selecting module. The environmental color temperature detecting module detects and obtains the color temperature of the environment in which the transparent display is located. The display color temperature adjusting module is configured to give different color temperature adjusting results according to the mode selected by the user and the color temperature of the environment, in which the transparent display is located, obtained by the environmental color temperature detecting module. As the user selects the display mode, the display color temperature adjusting module uses a preset fixed color temperature as the color temperature adjusting results; as the user selects the fusion mode, the display color temperature adjusting module uses a color temperature consistent with the color temperature of the environment, in which the transparent display is located, obtained by the environmental color temperature detecting module as the color temperature adjusting result. The transparent display receives the color temperature adjusting result and is controlled by the display color temperature adjusting module to perform the transparent displaying at the corresponding color temperature to realize the various color temperature adjustment based on the working mode of the transparent display to harmonize the transparent display color temperature with the environmental color temperature and to improve the transparent display viewing experience. The present invention provides a color temperature adjusting method of a transparent display is applied for the aforesaid color temperature adjusting system of the transparent display and can perform various color temperature adjustment based on the working mode of the transparent display to harmonize the transparent display color temperature with the environmental color temperature and to improve the transparent display viewing experience.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
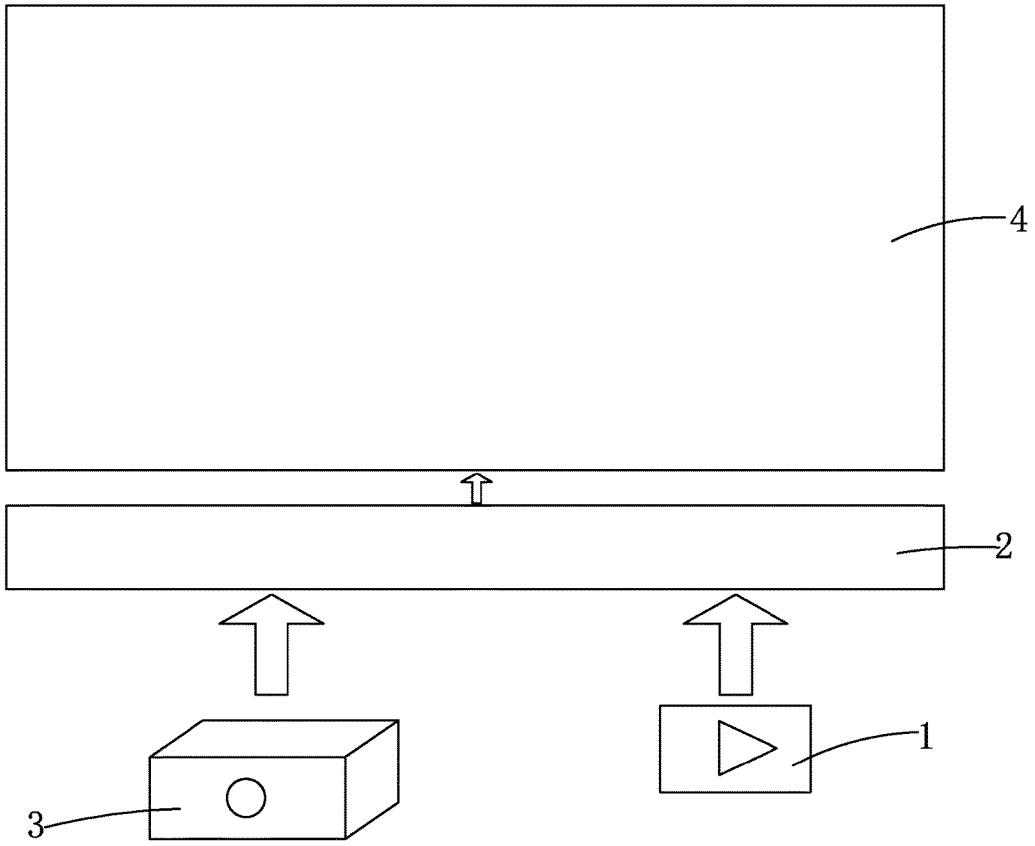
FIG. 1 is a simply structure diagram of a temperature color adjusting system of a transparent display according to the present invention.
Figure 2:
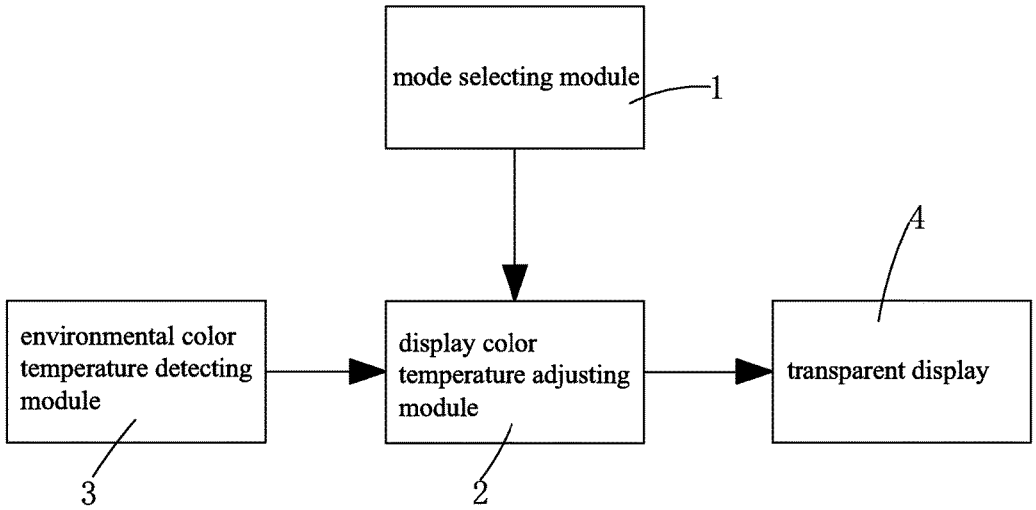
FIG. 2 is a structure block diagram of a temperature color adjusting system of a transparent display according to the present invention.

Please refer from FIG. 1 to FIG. 5. The present invention first provides a temperature color adjusting system of a transparent display. As shown in FIG. 1 and FIG. 2, the temperature color adjusting system of the transparent display according to the present invention comprises a mode selecting module 1, a display color temperature adjusting module 2 communicating with the mode selecting module 1, an environmental color temperature detecting module 3 communicating with the display color temperature adjusting module 2 and the transparent display 4 communicating with the display color temperature adjusting module 2.

The mode selecting module 1 has a display mode and a fusion mode for a user to select. The display mode emphasizes the display application of the transparent display 4 for seeking the best display effect; the fusion mode emphasizes the transparent application of the transparent display 4 for seeking the fusion of the image shown by the transparent display 4 and the background behind the transparent display 4. Specifically, the mode selecting module 1 allows selecting the mode with a bottom or a touch control but not limited thereto.

The environmental color temperature detecting module 3 detects and obtains a color temperature of an environment in which the transparent display 4 is located.

The display color temperature adjusting module 2 is configured to give different color temperature adjusting results according to a mode selected by the user and the color temperature of the environment, in which the transparent display 4 is located, obtained by the environmental color temperature detecting module 4. Specifically, as the user selects the display mode, the display color temperature adjusting module 2 uses a preset fixed color temperature as the color temperature adjusting result; as the user selects the fusion mode, the display color temperature adjusting module 2 uses a color temperature consistent with the color temperature of the environment, in which the transparent display 4 is located, obtained by the environmental color temperature detecting module 3 as the color temperature adjusting result.

The transparent display 4 receives the color temperature adjusting result of the display color temperature adjusting module 2 to perform a transparent display at the corresponding color temperature. Specifically, the transparent display 4 is a liquid crystal transparent display or an organic light emitting diode transparent display.

Figure 3:
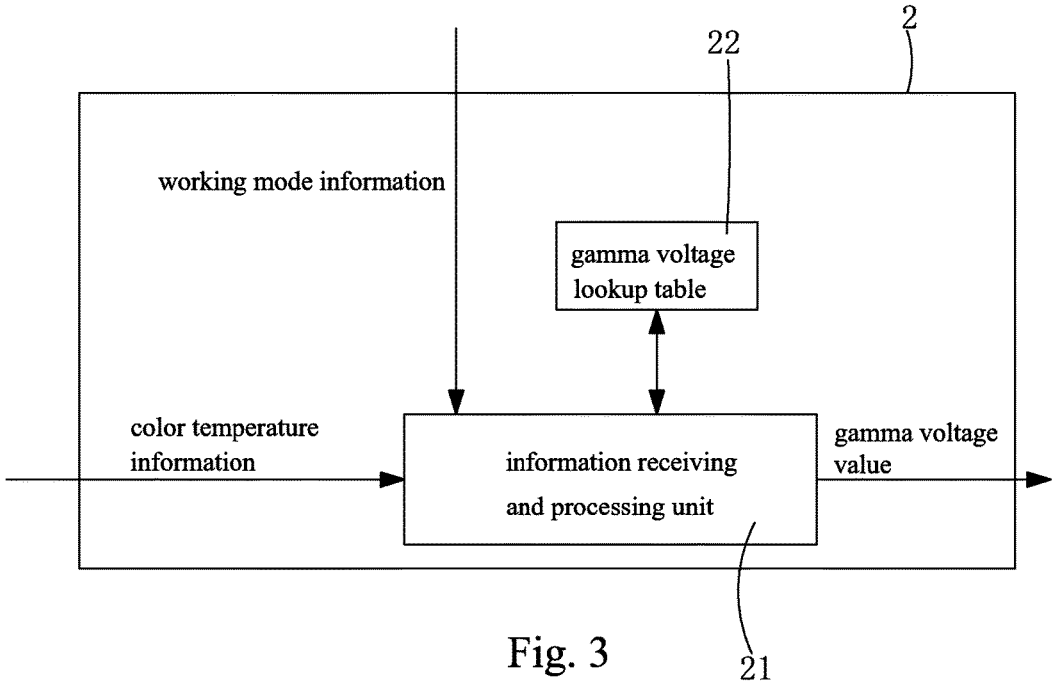
FIG. 3 is a structure block diagram of a display color temperature adjusting module in a temperature color adjusting system of a transparent display according to the present invention.

The display color temperature adjusting module 2 is a core module of the transparent display color temperature adjusting system of the present invention. As shown in FIG. 3, the display color temperature adjusting module 2 comprises an information receiving and processing unit 21 and a gamma voltage lookup table 22. The gamma voltage lookup table 22 stores a plurality of gamma voltage values and one gamma voltage value corresponds to one color temperature.

The information receiving and processing unit 21 receives information of the mode selected by the user and information of the color temperature of the environment, in which the transparent display 4 is located, obtained by the environmental color temperature detecting module 3 and retrieves the gamma voltage lookup table 22 according to received information and then, selects a gamma voltage value corresponding to the received information and transmits the gamma voltage value which is selected to the transparent display 4 to control the transparent display 4 to perform transparent displaying at the color temperature corresponding to the gamma voltage value which is selected. Furthermore, as the user selects the display mode, the information receiving and processing unit 21 selects a gamma voltage value corresponding to the preset fixed color temperature in the gamma voltage lookup table 22 to control the transparent display 4 to perform a transparent displaying at the preset fixed color temperature; as the user selects the fusion mode, the information receiving and processing unit 21 selects a gamma voltage value corresponding to the color temperature consistent with the color temperature of the environment, in which the transparent display 4 is located, obtained by the environmental color temperature detecting module 3 in the gamma voltage lookup table 22 to control the transparent display 4 to perform a transparent displaying at the color temperature consistent with the color temperature of the environment, in which the transparent display 4 is located, obtained by the environmental color temperature detecting module 3.

Figure 4:
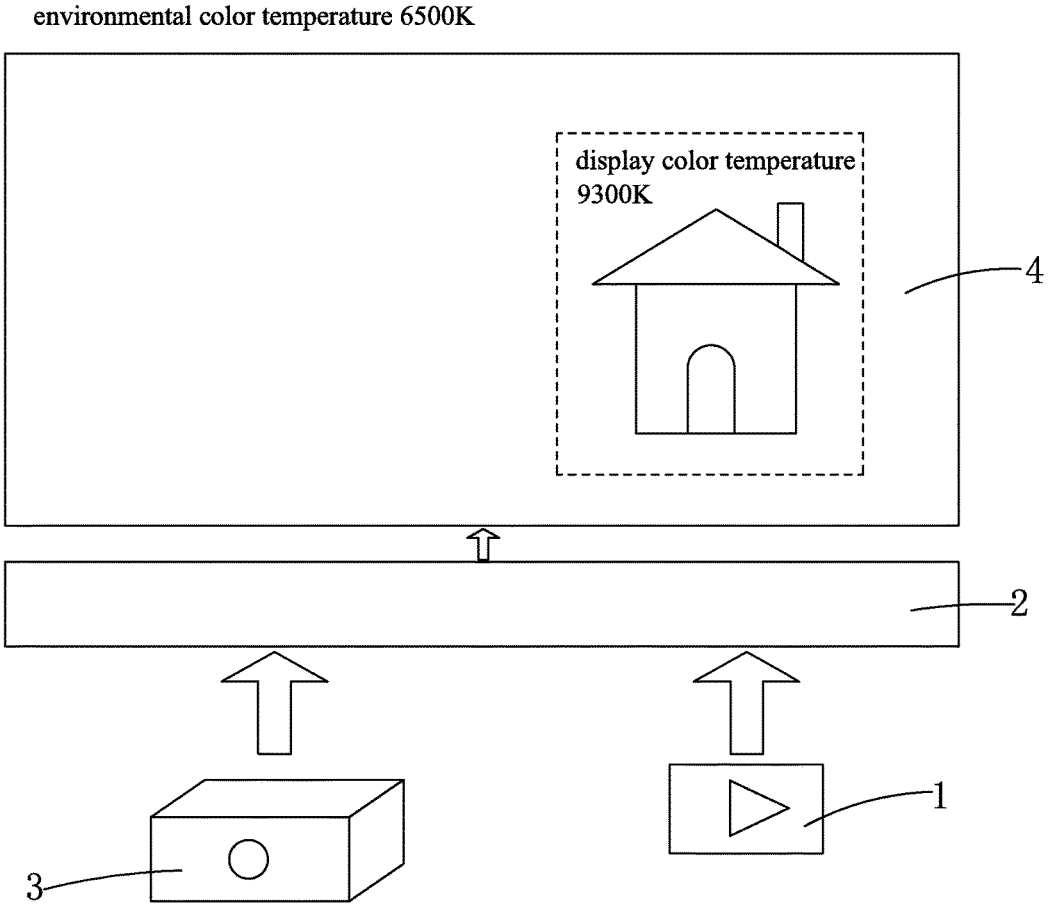
FIG. 4 is a diagram of a working state of a color temperature adjusting system of a transparent display according to the present invention in a display mode.
Figure 5:
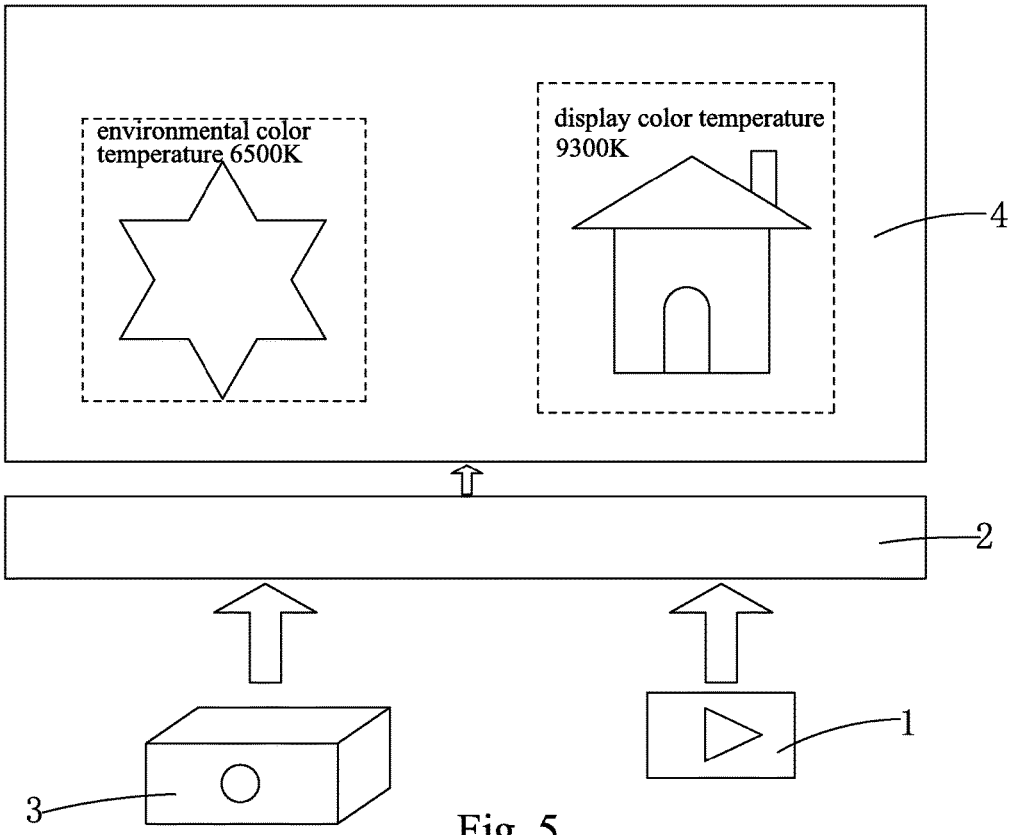
FIG. 5 is a diagram of a working state of a color temperature adjusting system of a transparent display according to the present invention in a fusion mode.

To apply the color temperature adjustment system of the transparent display according to the present invention to a shopping mall as an illustration shown in FIG. 4, as the transparent display 4 only plays the commercial advertisement, the display mode is selected via the mode selecting module 1. Under such circumstance, the environmental color temperature detecting module 3 detects that the color temperature of the environment in which the transparent display 4 is located is 6500K. However, in the display mode, the information receiving and processing unit 21 in the display color temperature adjusting module 2 selects a gamma voltage value corresponding to the preset fixed color temperature of 9300K in the gamma voltage lookup table 22 to control the transparent display 4 to perform the transparent displaying at the preset fixed color temperature of 9300K to achieve the optimum display effect. As shown in FIG. 5, as a physical commodity is placed behind the transparent display 4 and the transparent display 4 needs to show the auxiliary display information of the physical commodity while exhibiting the physical commodity, the fusion mode is selected via the mode selecting module 1. The color temperature of the environment, in which the transparent display 4 is located, detected and obtained by the environmental color temperature detecting module 3, is 6500K. The information receiving and processing unit 21 in the display color temperature adjusting module 2 selects a gamma voltage value corresponding to the color temperature of the environment of 6500K in the gamma voltage lookup table 22 to control the transparent display 4 to perform the transparent displaying at the color temperature of 6500K. Accordingly, the color temperature of the auxiliary display information shown in the transparent display 4 is consistent with the color temperature of the environment in which the physical commodity is located to avoid the inharmony caused by the significant difference of the display color temperature and the color temperature of the environment to improve the transparent display viewing experience.

Figure 6:
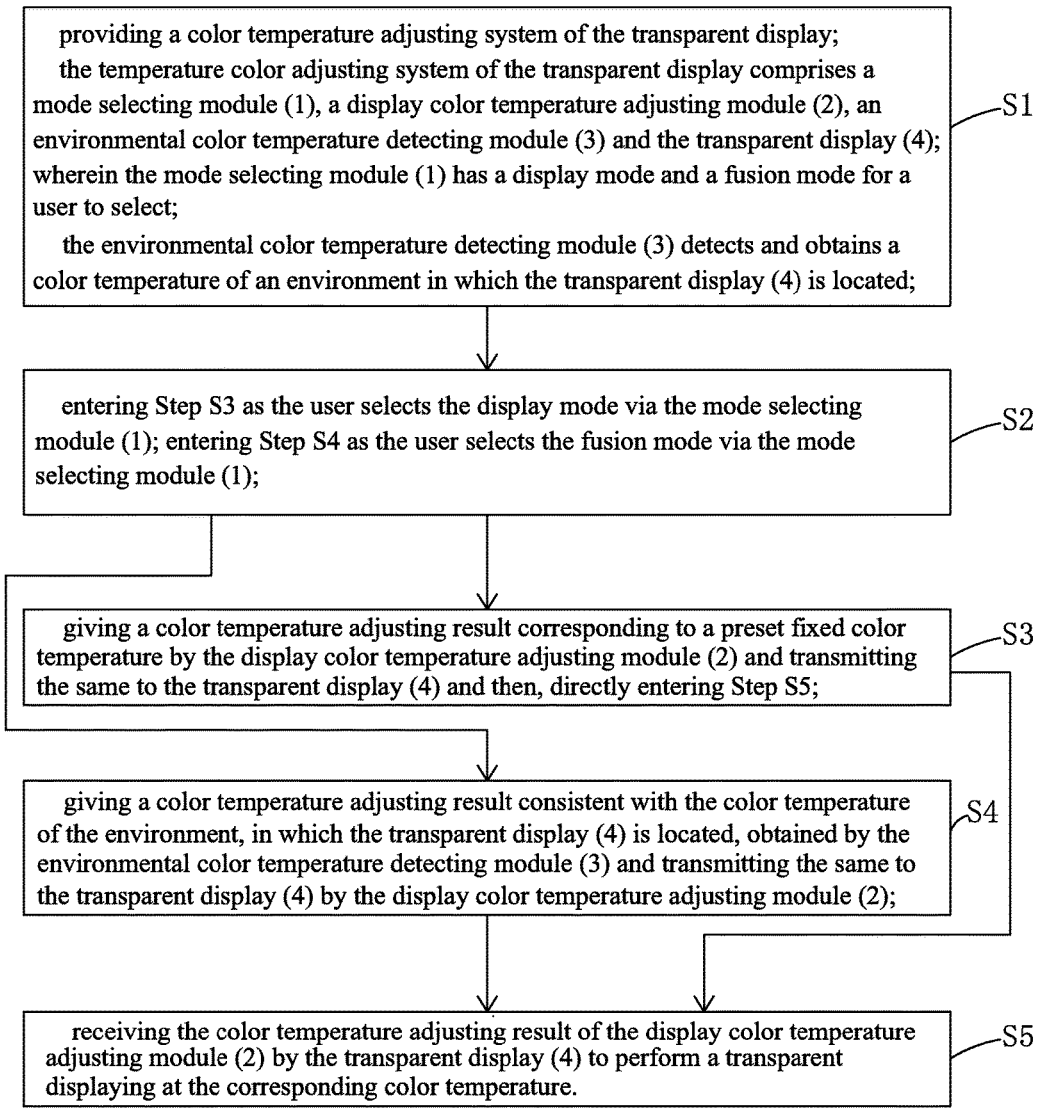
FIG. 6 is a flowchart of a temperature color adjusting method of a transparent display according to the present invention.

Please refer to FIG. 6. On the basis of the same inventive idea, the present invention further provides a color temperature adjusting method of a transparent display, comprising steps of:

Step S1, providing a color temperature adjusting system of the transparent display.

With the combination of FIG. 1 and FIG. 2, the temperature color adjusting system of the transparent display comprises a mode selecting module 1, a display color temperature adjusting module 2 communicating with the mode selecting module 1, an environmental color temperature detecting module 3 communicating with the display color temperature adjusting module 2 and the transparent display 4 communicating with the display color temperature adjusting module 2.

The environmental color temperature detecting module 3 detects and obtains a color temperature of an environment in which the transparent display 4 is located.

Specifically, as shown in FIG. 3, the display color temperature adjusting module 2 comprises an information receiving and processing unit 21 and a gamma voltage lookup table 22. The gamma voltage lookup table 22 stores a plurality of gamma voltage values and one gamma voltage value corresponds to one color temperature.

The transparent display 4 is a liquid crystal transparent display or an organic light emitting diode transparent display.

Step S2, entering Step S3 as the user selects the display mode via the mode selecting module 1; entering Step S4 as the user selects the fusion mode via the mode selecting module 1.

Specifically, Step S2 allows selecting the mode with a bottom or a touch control via the mode selecting module 1 but not limited thereto.

Step S3, giving a color temperature adjusting result corresponding to a preset fixed color temperature by the display color temperature adjusting module 2 and transmitting the same to the transparent display 4 and then, directly entering Step S5.

Specifically, the information receiving and processing unit 21 in the display color temperature adjusting module 2 receives information of the mode selected by the user and retrieves the gamma voltage lookup table 22 according to received information and then, selects a fixed gamma voltage value in the gamma voltage lookup table 22 and transmits the same to the transparent display 4. The fixed gamma voltage value corresponds to the preset fixed color temperature to control the transparent display 4 to perform a transparent displaying at the preset fixed color temperature.

Step S4, giving a color temperature adjusting result consistent with the color temperature of the environment, in which the transparent display 4 is located, obtained by the environmental color temperature detecting module 3 and transmitting the same to the transparent display 4 by the display color temperature adjusting module 2.

Specifically, the information receiving and processing unit 21 in the display color temperature adjusting module 2 receives information of the mode selected by the user and retrieves the gamma voltage lookup table 22 according to received information and then, selects a gamma voltage value corresponding to the color temperature consistent with the color temperature of the environment, in which the transparent display 4 is located, obtained by the environmental color temperature detecting module 3 in the gamma voltage lookup table 22 to control the transparent display 4 to perform a transparent displaying at the color temperature consistent with the color temperature of the environment, in which the transparent display 4 is located, obtained by the environmental color temperature detecting module 3.

Step S5, receiving the color temperature adjusting result of the display color temperature adjusting module 2 by the transparent display 4 to perform a transparent displaying at the corresponding color temperature.

Specifically, in case of following Step S3, the transparent display 4 performs the transparent displaying at the preset fixed color temperature; in case of following Step S4, the transparent display 4 performs the transparent displaying at color temperature consistent with the color temperature of the environment, in which the transparent display 4 is located, obtained by the environmental color temperature detecting module 3.

The aforesaid color temperature adjusting method of the transparent display can perform various color temperature adjustment based on the working mode of the transparent display to harmonize the transparent display color temperature with the environmental color temperature and to improve the transparent display viewing experience.

In conclusion, in the color temperature adjusting system of the transparent display according to the present invention, the display mode or the fusion mode is selected via the mode selecting module. The environmental color temperature detecting module detects and obtains the color temperature of the environment in which the transparent display is located. The display color temperature adjusting module is configured to give different color temperature adjusting results according to the mode selected by the user and the color temperature of the environment, in which the transparent display is located, obtained by the environmental color temperature detecting module. As the user selects the display mode, the display color temperature adjusting module uses a preset fixed color temperature as the color temperature adjusting results; as the user selects the fusion mode, the display color temperature adjusting module uses a color temperature consistent with the color temperature of the environment, in which the transparent display is located, obtained by the environmental color temperature detecting module as the color temperature adjusting result. The transparent display receives the color temperature adjusting result and is controlled by the display color temperature adjusting module to perform the transparent displaying at the corresponding color temperature to realize the various color temperature adjustment based on the working mode of the transparent display to harmonize the transparent display color temperature with the environmental color temperature and to improve the transparent display viewing experience. The color temperature adjusting method of the transparent display according to the present invention is applied for the aforesaid color temperature adjusting system of the transparent display and can perform various color temperature adjustment based on the working mode of the transparent display to harmonize the transparent display color temperature with the environmental color temperature and to improve the transparent display viewing experience.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A color temperature adjusting system of a transparent display, comprising a mode selecting module, a display color temperature adjusting module communicating with the mode selecting module, an environmental color temperature detecting module communicating with the display color temperature adjusting module and the transparent display communicating with the display color temperature adjusting module;

wherein the mode selecting module has a display mode and a fusion mode for a user to select;

the environmental color temperature detecting module detects and obtains a color temperature of an environment in which the transparent display is located;

the display color temperature adjusting module is configured to give different color temperature adjusting results according to a mode selected by the user and the color temperature of the environment, in which the transparent display is located, obtained by the environmental color temperature detecting module: as the user selects the display mode, the display color temperature adjusting module uses a preset fixed color temperature as the color temperature adjusting result; as the user selects the fusion mode, the display color temperature adjusting module uses a color temperature consistent with the color temperature of the environment, in which the transparent display is located, obtained by the environmental color temperature detecting module as the color temperature adjusting result;

the transparent display receives the color temperature adjusting result of the display color temperature adjusting module to perform a transparent display at the corresponding color temperature, wherein the display color temperature adjusting module comprises an information receiving and processing unit and a gamma voltage lookup table; the gamma voltage lookup table stores a plurality of gamma voltage values and one gamma voltage value corresponds to one color temperature;

the information receiving and processing unit receives information of the mode selected by the user and information of the color temperature of the environment, in which the transparent display is located, obtained by the environmental color temperature detecting module and retrieves the gamma voltage lookup table according to received information and then, selects a gamma voltage value corresponding to the received information and transmits the gamma voltage value which is selected to the transparent display to control the transparent display to perform transparent displaying at the color temperature corresponding to the gamma voltage value which is selected.

2. The color temperature adjusting system of the transparent display according to claim 1, wherein the mode selecting module allows selecting the mode with a bottom or a touch control.

3. The color temperature adjusting system of the transparent display according to claim 1, wherein as the user selects the display mode, the information receiving and processing unit selects a gamma voltage value corresponding to the preset fixed color temperature in the gamma voltage lookup table to control the transparent display to perform a transparent displaying at the preset fixed color temperature; as the user selects the fusion mode, the information receiving and processing unit selects a gamma voltage value corresponding to the color temperature consistent with the color temperature of the environment, in which the transparent display is located, obtained by the environmental color temperature detecting module in the gamma voltage lookup table to control the transparent display to perform a transparent displaying at the color temperature consistent with the color temperature of the environment, in which the transparent display is located, obtained by the environmental color temperature detecting module.

4. The color temperature adjusting system of the transparent display according to claim 1, wherein the transparent display is a liquid crystal transparent display or an organic light emitting diode transparent display.

5. A color temperature adjusting method of a transparent display, comprising steps of:

Step S1, providing a color temperature adjusting system of the transparent display;

wherein the color temperature adjusting system comprises a mode selecting module, a display color temperature adjusting module communicating with the mode selecting module, an environmental color temperature detecting module communicating with the display color temperature adjusting module and the transparent display communicating with the display color temperature adjusting module; wherein the mode selecting module has a display mode and a fusion mode for an user to select;

the environmental color temperature detecting module detects and obtains a color temperature of an environment in which the transparent display is located;

Step S2, entering Step S3 as the user selects the display mode via the mode selecting module; entering Step S4 as the user selects the fusion mode via the mode selecting module;

Step S3, giving a color temperature adjusting result corresponding to a preset fixed color temperature by the display color temperature adjusting module and transmitting the same to the transparent display and then, directly entering Step S5;

Step S4, giving a color temperature adjusting result consistent with the color temperature of the environment, in which the transparent display is located, obtained by the environmental color temperature detecting module and transmitting the same to the transparent display by the display color temperature adjusting module;

Step S5, receiving the color temperature adjusting result of the display color temperature adjusting module by the transparent display to perform a transparent displaying at the corresponding color temperature; wherein the display color temperature adjusting module comprises an information receiving and processing unit and a gamma voltage lookup table; the gamma voltage lookup table stores a plurality of gamma voltage values and one gamma voltage value corresponds to one color temperature;

the information receiving and processing unit receives information of the mode selected by the user and information of the color temperature of the environment, in which the transparent display is located, obtained by the environmental color temperature detecting module and retrieves the gamma voltage lookup table according to received information and then, selects a gamma voltage value corresponding to the received information and transmits the gamma voltage value which is selected to the transparent display to control the transparent display to perform transparent displaying at the color temperature corresponding to the gamma voltage value which is selected.

6. The color temperature adjusting method of the transparent display according to claim 5, wherein the mode selecting module allows selecting the mode with a bottom or a touch control.

7. The color temperature adjusting method of the transparent display according to claim 5, wherein as the user selects the display mode, the information receiving and processing unit selects a gamma voltage value corresponding to the preset fixed color temperature in the gamma voltage lookup table to control the transparent display to perform a transparent displaying at the preset fixed color temperature; as the user selects the fusion mode, the information receiving and processing unit selects a gamma voltage value corresponding to the color temperature consistent with the color temperature of the environment, in which the transparent display is located, obtained by the environmental color temperature detecting module to control the transparent display to perform a transparent displaying at the color temperature consistent with the color temperature of the environment, in which the transparent display is located, obtained by the environmental color temperature detecting module.

8. The color temperature adjusting method of the transparent display according to claim 5, wherein the transparent display is a liquid crystal transparent display or an organic light emitting diode transparent display.

9. A color temperature adjusting system of a transparent display, comprising a mode selecting module, a display color temperature adjusting module communicating with the mode selecting module, an environmental color temperature detecting module communicating with the display color temperature adjusting module and the transparent display communicating with the display color temperature adjusting module;

wherein the mode selecting module has a display mode and a fusion mode for a user to select;

the environmental color temperature detecting module detects and obtains a color temperature of an environment in which the transparent display is located;

the display color temperature adjusting module is configured to give different color temperature adjusting results according to a mode selected by the user and the color temperature of the environment, in which the transparent display is located, obtained by the environmental color temperature detecting module: as the user selects the display mode, the display color temperature adjusting module uses a preset fixed color temperature as the color temperature adjusting result; as the user selects the fusion mode, the display color temperature adjusting module uses a color temperature consistent with the color temperature of the environment, in which the transparent display is located, obtained by the environmental color temperature detecting module as the color temperature adjusting result;

the transparent display receives the color temperature adjusting result of the display color temperature adjusting module to perform a transparent display at the corresponding color temperature;

wherein the mode selecting module allows selecting the mode with a bottom or a touch control;

wherein the display color temperature adjusting module comprises an information receiving and processing unit and a gamma voltage lookup table; the gamma voltage lookup table stores a plurality of gamma voltage values and one gamma voltage value corresponds to one color temperature;

the information receiving and processing unit receives information of the mode selected by the user and information of the color temperature of the environment, in which the transparent display is located, obtained by the environmental color temperature detecting module and retrieves the gamma voltage lookup table according to received information and then, selects a gamma voltage value corresponding to the received information and transmits the gamma voltage value which is selected to the transparent display to control the transparent display to perform transparent displaying at the color temperature corresponding to the gamma voltage value which is selected;

wherein as the user selects the display mode, the information receiving and processing unit selects a gamma voltage value corresponding to the preset fixed color temperature in the gamma voltage lookup table to control the transparent display to perform a transparent displaying at the preset fixed color temperature; as the user selects the fusion mode, the information receiving and processing unit selects a gamma voltage value corresponding to the color temperature consistent with the color temperature of the environment, in which the transparent display is located, obtained by the environmental color temperature detecting module in the gamma voltage lookup table to control the transparent display to perform a transparent displaying at the color temperature consistent with the color temperature of the environment, in which the transparent display is located, obtained by the environmental color temperature detecting module;

wherein the transparent display is a liquid crystal transparent display or an organic light emitting diode transparent display.

* * * * *